US006345481B1

(12) United States Patent
Nelson

(10) Patent No.: US 6,345,481 B1
(45) **Date of Patent: *Feb. 12, 2002**

(54) ARTICLE WITH INTERLOCKING EDGES AND COVERING PRODUCT PREPARED THEREFROM

(75) Inventor: Thomas John Nelson, Belton, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/291,587

(22) Filed: Apr. 12, 1999

Related U.S. Application Data

(63) Continuation-in-part of application No. 08/977,536, filed on Nov. 25, 1997.

(51) Int. Cl.[7] ..... E04F 15/10
(52) U.S. Cl. ..... 52/592.2; 52/592.4
(58) Field of Search ..... 52/589.1, 591.1, 52/591.3, 592.1, 592.2, 592.4, 309.9, 309.14, 592.03

(56) References Cited

U.S. PATENT DOCUMENTS

| | | | | |
|---|---|---|---|---|
| 1,124,228 A | | 1/1915 | Houston | |
| 2,142,305 A | * | 1/1939 | Davis | 52/592.1 |
| 2,204,675 A | | 6/1940 | Grunert | |
| 2,430,200 A | | 11/1947 | Wilson | |
| 2,453,918 A | | 11/1948 | Jansen | |
| 2,740,167 A | * | 4/1956 | Rowley | |
| 3,100,556 A | | 8/1963 | De Ridder | |
| 3,111,205 A | | 11/1963 | Gresham | |
| 3,128,851 A | | 4/1964 | Deridder et al. | |
| 3,182,769 A | | 5/1965 | De Ridder | |
| 3,310,919 A | | 3/1967 | Bue et al. | |
| 3,385,182 A | | 5/1968 | Harvey | |
| 3,526,240 A | | 9/1970 | Oroza | |
| 3,538,665 A | | 11/1970 | Gohner | |
| 3,590,545 A | | 7/1971 | Webb | |

(List continued on next page.)

FOREIGN PATENT DOCUMENTS

| | | | | |
|---|---|---|---|---|
| CA | 759196 | * | 5/1967 | 52/592.2 |
| DE | 200949 | | 1/1939 | |
| DE | 7102476 | | 1/1971 | |
| DE | 2159042 | * | 6/1973 | 52/592.2 |
| DE | 1 534 278 | | 12/1973 | |
| DE | 25 02 992 | | 1/1975 | |
| DE | 26 16 077 | | 4/1976 | |
| DE | 30 41 781 | | 6/1982 | |
| DE | 2 147 623 | | 5/1985 | |
| DE | 3343601 | | 6/1985 | |
| DE | 35 44 845 | | 12/1985 | |
| DE | 86 04 004 | | 4/1986 | |
| DE | 33 43 601 | | 2/1987 | |
| DE | 8629521 | | 2/1987 | |
| DE | 86 29 951 | | 2/1987 | |

(List continued on next page.)

OTHER PUBLICATIONS

Parador Flooring Product Advertisement for Parador Holzwerke GmbH & Co. KG, Australian House and Garden Jun. 2001, ";"; p. 133.

*Primary Examiner*—Michael Safavi
(74) *Attorney, Agent, or Firm*—Welsh & Flaxman LLC

(57) ABSTRACT

An article that is suitable for use in surface coverings, such as laminate floorings, wherein the article has at least one interlocking edge of a first profile and at least one interlocking edge of a second profile. The interlocking edges provide the ability to interlock adjacent articles without the need for an adhesive, and yet form a substantially gapless seam between the articles. The articles may be joined and unjoined from each other a plurality of times without any substantial deterioration of the interlocking edge profiles.

37 Claims, 6 Drawing Sheets

U.S. PATENT DOCUMENTS

| | | | | | |
|---|---|---|---|---|---|
| 3,657,852 | A | | 4/1972 | Worthington et al. | |
| 3,694,983 | A | | 10/1972 | Couquet | |
| 3,823,525 | A | | 7/1974 | Bruun | |
| 3,859,000 | A | | 1/1975 | Webster | |
| 4,125,984 | A | | 11/1978 | Jonas | |
| 4,226,064 | A | | 10/1980 | Kraayenhof | |
| 4,296,582 | A | | 10/1981 | Simpson et al. | |
| 4,426,820 | A | * | 1/1984 | Terbrack et al. | |
| 4,449,346 | A | | 5/1984 | Tremblay | |
| 4,461,131 | A | | 7/1984 | Pressell | |
| 4,599,842 | A | | 7/1986 | Counihan | 52/586 |
| 4,741,136 | A | * | 5/1988 | Thompson | 52/592.2 |
| 4,769,963 | A | | 9/1988 | Meyerson | |
| 4,796,402 | A | | 1/1989 | Pajala | |
| 4,845,907 | A | | 7/1989 | Meek | |
| 4,905,442 | A | | 3/1990 | Daniels | |
| 4,917,532 | A | | 4/1990 | Haberhauer et al. | |
| 5,022,200 | A | | 6/1991 | Wilson et al. | |
| 5,086,599 | A | | 2/1992 | Meyerson | |
| 5,157,890 | A | | 10/1992 | Jines | |
| 5,179,812 | A | | 1/1993 | Hill | |
| 5,274,979 | A | | 1/1994 | Tsai | |
| 5,295,341 | A | | 3/1994 | Kajiwara | |
| 5,332,075 | A | | 7/1994 | Quigley et al. | |
| 5,348,778 | A | | 9/1994 | Knipp et al. | |
| 5,349,796 | A | * | 9/1994 | Meyerson | 52/589.1 |
| 5,497,589 | A | * | 3/1996 | Porter | 52/592.1 |
| 5,618,602 | A | | 4/1997 | Nelson | |
| 5,622,012 | A | * | 4/1997 | Schijf | 52/592.2 |
| 5,706,621 | A | | 1/1998 | Pervan | |
| 5,736,227 | A | | 4/1998 | Sweet et al. | |
| 6,006,486 | A | * | 12/1999 | Moriau et al. | 52/592.1 |
| 6,094,882 | A | | 8/2000 | Pervan | 52/745.19 |
| 6,134,854 | A | | 10/2000 | Stanchfield | 52/480 |
| 6,182,410 | B1 | | 2/2001 | Pervan | 52/403.1 |
| 6,205,639 | B1 | | 3/2001 | Pervan | 29/509 |

FOREIGN PATENT DOCUMENTS

| | | | |
|---|---|---|---|
| DE | 4242 530 | A1 | 6/1994 |
| DE | 295 20 966 | | 8/1996 |
| DE | 197 13 542 | A1 | 10/1998 |
| EP | 1430423 | | 5/1973 |
| EP | 1534278 | | 12/1973 |
| EP | 248 127 | | 6/1986 |
| EP | 558767 | A1 | 9/1993 |
| EP | WP94/26999 | | 11/1994 |
| EP | 0855482 | B1 | 12/1999 |
| EP | 0877130 | B1 | 1/2000 |
| EP | 0969164 | A2 | 1/2000 |
| FI | 843060 | | 8/1984 |
| FR | 1239043 | | 4/1962 |
| FR | 2061044 | | 9/1970 |
| FR | 2108402 | | 5/1972 |
| FR | 2210165 | | 12/1973 |
| FR | 2292144 | | 11/1974 |
| FR | 2 568 295 | | 1/1986 |
| FR | 2629146 | | 3/1988 |
| FR | 2697275 | | 10/1992 |
| GB | 424057 | | 7/1934 |
| GB | 1237744 | | 6/1971 |
| GB | 1275511 | | 5/1972 |
| GB | 1 430 423 | | 5/1973 |
| GB | 1496489 | | 12/1974 |
| GB | 2117813 | | 10/1983 |
| GB | 2126106 | A | 3/1984 |
| GB | 2175680 | | 12/1986 |
| GB | 2256023 | | 5/1991 |
| JP | 54-65528 | | 5/1979 |
| JP | 57-119056 | | 7/1982 |
| JP | 3-169967 | | 7/1991 |
| SE | 7114900-9 | | 5/1973 |
| SE | 8206934-5 | | 6/1984 |
| SE | HU 214 470 | B | 4/1994 |
| WO | WO 84/02155 | | 6/1984 |
| WO | WO 86/05754 | | 10/1986 |
| WO | WO 90/00656 | | 1/1990 |
| WO | WO 93/13280 | | 7/1993 |
| WO | WO 94/04773 | | 3/1994 |
| WO | WO 94/26999 | | 11/1994 |
| WO | WO 96/06241 | | 2/1996 |
| WO | WO 97/21011 | | 6/1997 |
| WO | WO 97/47834 | | 12/1997 |
| WO | WO 00/20706 | | 4/2000 |

* cited by examiner

ARTICLE WITH INTERLOCKING EDGES AND COVERING PRODUCT PREPARED THEREFROM

This application is a continuation-in-part of copending application Ser. No. 08/977,536 filed on Nov. 25, 1997.

BACKGROUND OF THE INVENTION

1. Field of the Invention

The present invention relates to an article having interlocking edges and its use as a covering product, particularly useful for covering flat surfaces such as floors, and most useful in preparing a flooring product that is easy to install, easy to remove, and easy to repair.

2. Discussion of the Background

In recent years the use of laminate products in the flooring industry as a replacement or substitute for traditional wood plank flooring has grown tremendously due to the durability and ease of care of the laminate products. However, the laminate flooring products currently available often have several disadvantages.

Many conventional laminate floor products have "tongue and groove" edges that are machined to fit one into the other. However, the conventional method for preparing such edges provides an interference fit that is glued together, particularly in "floating floor" systems. In the interference fit type of edge, any glue that is placed in the cutout portion of the edge must be forced out upon insertion of the corresponding edge on an adjacent piece of laminate. Gluing floor panels together is time consuming and messy; any glue that seeps out onto the floor surface must be cleaned up by the installer. Due to the tight fit, the fitting together of the laminate pieces also typically requires pressure and clamps to hold the pieces together until the glue in the seams dries. Naturally, the floor cannot be walked on until the glue dries and the clamps are removed.

Additionally when the pieces are joined, and the glue is forced out of the cutout edge, there is no way to control the direction in which the glue will exit. It can exit either in an upwards direction towards the visible surface of the flooring, causing a mess, or in a downwards direction to the surface adjacent the subflooring. Either case may be detrimental to both the appearance and function of the resulting floor.

Additionally, for direct gluedown applications glue is placed on the bottom surface of the flooring section to adhere it to the subfloor. Once the glue sets, the resulting floor can be extremely difficult or impossible to repair or replace. Additionally, due to expansion and/or contraction within individual sections of laminate flooring, the resulting floor can undergo various stresses causing distortions, buckling, etc., thus rendering the floor aesthetically unsightly.

Also, some prior art methods of attaching adjoining flooring panels require that channels of significant size be machined into the underside of the flooring panels. Such a prior art method is described in U.S. Pat. No. 5,860,267 by Pervan. This prior art method requires that the channels be machined into the underside of the panels a considerable distance from the panel edges, and configured so as to accept a separate piece that is connected to each panel to provide a means for attachment of adjacent panels. These channels weaken the panels, increase manufacturing cost, and result in more opportunity for panel warpage under the influence of moisture.

A new means of attaching individual flooring panels, particularly in the laminate flooring arena, is needed to overcome these disadvantages.

SUMMARY OF THE INVENTION

Accordingly, one object of the present invention is to provide a new surface covering product that is easy to install, can be installed without glue if desired, is easy to repair and/or replace, and may be used as soon as it is installed.

A further object of the present invention is to provide a new surface covering product having an edge design that can be assembled and disassembled in a simple manner without tools or glue.

Another object of the present invention is to provide a surface covering product that has a substantially hydrophobic interior to provide a watertight seam between sections.

Another object of the present invention is to provide a laminate flooring prepared from the surface covering product of the present invention.

Another object of the present invention is to provide a surface covering product that can be used as flooring, wall covering, ceilings and on curved surfaces.

Disclosed is a rectilinear surfacing article comprising substantially planar surfaces. The article has at least one first interlocking edge having a first profile and at least one second interlocking edge having a second profile, the second profile being complementary to the first profile. The first profile includes a male member located between two female members, and the second profile includes a female member located between two male members.

Each of the articles may be joined to a second adjacent article of like construction by causing a first interlocking edge and a second interlocking edge of two adjacent articles to approach one another at an angle $\alpha$, wherein $\alpha$ represents an angle formed by the planar surfaces of the two articles. Next, the complementary profiles of the articles are engaged. Finally, the planar surfaces of the two articles are caused to become coplanar to form a substantially gapless seam between the adjacent articles. The articles thereafter cannot be separated by a tensile force applied in the plane of the articles and substantially perpendicular to the longitudinal direction of the seam without breaking at least one of the interlocking edges. The articles may be joined and unjoined a plurality of times without functional deterioration of the first and second interlocking edges.

The rectilinear floor surfacing article may be installed over a flexible pad, whereby the seam effectively forms a flexible joint such that when weight is applied to the seam the articles rotate slightly about the joint as the seam is slightly depressed into the flexible pad. The flexible joint is constructed so as to prevent any damage from occurring to the first and second interlocking edges as a result of the rotation of the articles under the applied weight.

The above mentioned male member of the first profile may be configured to project outwardly from the first interlocking edge and upwardly toward the plane of the upper surface of the articles. The first profile may further include a concavity on the first interlocking edge located between the upper surface and a proximal end of the male member of the first profile. The second profile may further include an upper male member on the second interlocking edge located between the upper surface and the female member of the second profile. The upper male member of the second interlocking edge may have a convex distal end. Engagement of these complementary profiles forms a rotatable joint wherein the convex distal end of the upper male member of the second interlocking edge is seated into the concavity of the first interlocking edge, the rotatable joint being amenable to rotation about the seam when under pressure from above.

Also disclosed is an interlocking end profile configuration, which includes one first interlocking end having a first end profile, one second interlocking end having a second end profile, the second end profile being substantially complementary to the first end profile. The first end profile includes a male member located between two female members, and the second end profile includes a female member located between two male members. The first end profile includes a notched surface on the first male member which faces upwardly and outwardly. The second end profile includes a notched surface on the second upper male member which faces downwardly and outwardly.

The first interlocking end of a first article may be engaged with the second interlocking end of a third article of like construction by sliding a first article along the longitudinal axis of a previously engaged interlocked edge seam, engaging the complementary end profiles of the articles, and snapping the complementary end profiles together to form a substantially gapless end seam.

The planar surfaces of the articles may be formed by laminating a surfacing material onto a central core. The central core may be made of a material selected from the group consisting of fiberboard, solid polymeric materials, and foamed polymeric materials. The central core may also be made of a hydrophobic polymer, or a foamed polyvinyl chloride, polyacrylonitrile-co-butadiene-co-styrene (ABS), polyamide, or high impact polystyrene (HIPS). The foamed polymeric material has a density reduction of from 0 to 50%. The upper decorative planar surface may be high pressure decorative laminate, polymeric surfacing material, wood veneer, or any other decorative surfacing material.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
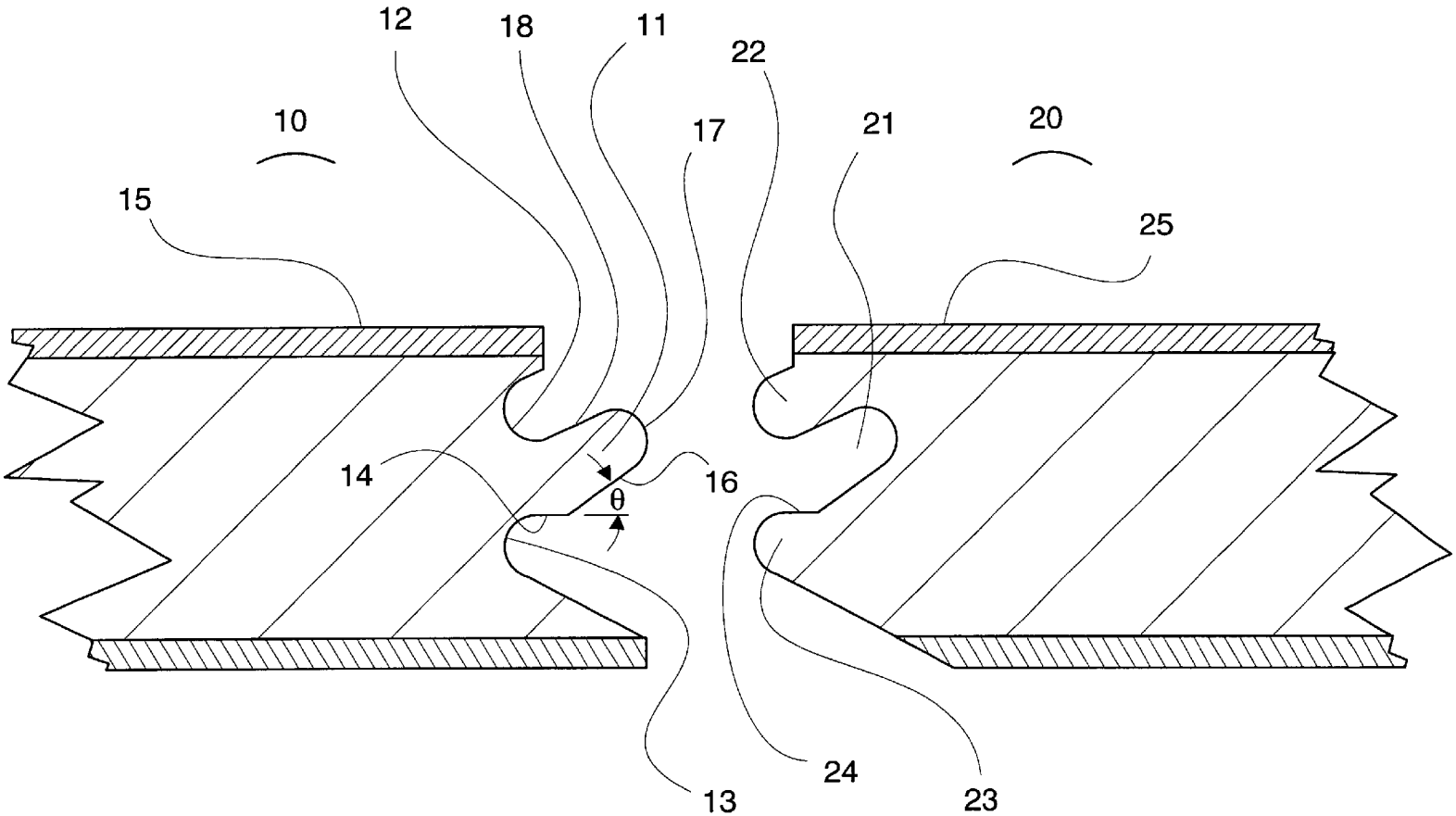
FIG. 1A shows an embodiment of the interlocking profiles of the side edges of the present invention.

The article of the present invention may be made of a uniform material, such as wood, plastic, etc., or may comprise a central core having upper and lower surfaces of a different material than that of the central core, as well as a plurality of edge surfaces around its periphery. The surface layers may be high pressure decorative laminate, solid surfacing veneer, wood veneer, or solid surfacing laminate (such as that described in U.S. application Ser. No. 08/899,118); or any other conventional decorative layer that can be bonded to a central core. Preferably, the upper surface is a high pressure decorative laminate layer, and the lower surface is a laminate backer. The upper and lower surface layers may be the same or different materials. The decorative layers can be formed from a variety of materials. Suitable materials for the decorative layers include, but are not limited to, conventional high pressure decorative laminate (made from melamine formaldehyde impregnated kraft paper layers), wood veneers, or conventional polymeric solid surfacing veneers or laminates. The decorative layers can be attached to the core using conventional means, such as adhesives, or by coextrusion of the core and decorative layers, either with or without a tie layer.

Whether or not the core forms the entire article, the core can be prepared from wood, wood based products such as fiberboard (such as high density fiberboard), polymeric materials etc. Suitable polymeric materials include, but are not limited to, rigid thermoplastics and thermosets, as well as more flexible elastomers and rubbers. When the article of the present invention is to be used to form a surface covering for a curved surface (either concave or convex), the article is preferably made from one of these more flexible materials in order to more accurately conform to the curved surface.

The core of the present product can be formed from a variety of materials, such as wood or wood based products, plastics, metals, etc. In order to gain the maximum in waterproofing and dimensional stability over time, it is preferred to make the central core from a plastic, more preferably from a hydrophobic polymer. Suitable hydrophobic polymers include polyvinyl chloride, polystyrene, polyolefins, etc. The core is most preferably prepared from a foamed hydrophobic polymer, such as an ABS, HIPS, or polyvinyl chloride foam, having a preferred density reduction of from 0 to 50%, more preferably from 20 to 40% density reduction, most preferably about 30% density reduction. Within the context of the present invention, the term "density reduction" is defined as the percentage by which the density of the foam is lower than the density of the unfoamed polymer that comprises the foam. The use of the hydrophobic polymer foam of the present invention provides both improved watertight seam properties as well as ease of handling due to the lighter weight of the foam.

A polymeric core can be formed by any conventional process, including but not limited to, molding, casting, extrusion, etc. When the core is made from a fiberboard or chipboard composition, the core can be prepared by any conventional process. When the article is a solid piece of wood, the article can be prepared by conventional woodworking techniques, so long as the edge profile is prepared to meet the requirements of the invention. The profile of the edges of the laminate flooring of the present invention can be formed by routing, cutting, etc. as needed. Further, when the core is made from a polymeric material, the profile of the edges may be made by cutting, or may be formed by extruding the core with the profiles intact.

Figure 1B:
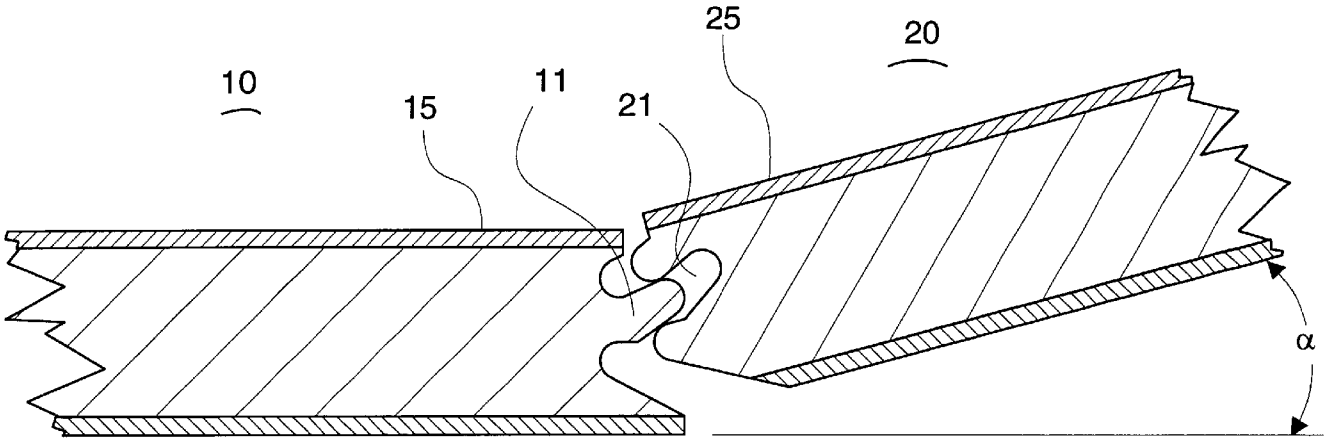
FIG. 1B shows preliminary engagement of the interlocking profiles of FIG. 1A.
Figure 1C:
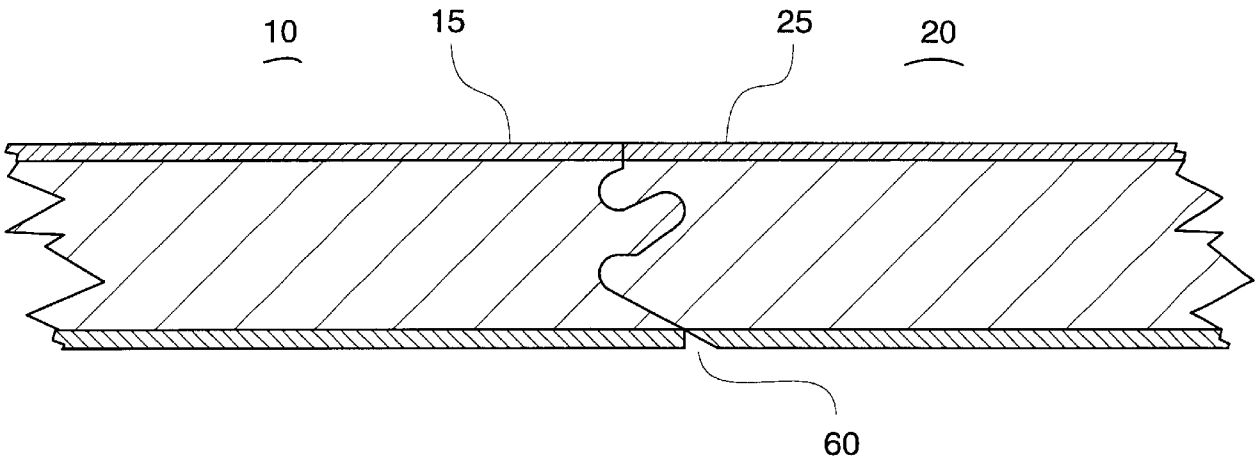
FIG. 1C shows final engagement of the interlocking profiles of FIG. 1A.

As shown in FIG. 1A, the article of the present invention may have substantially planar upper and lower surfaces, with at least one first interlocking edge having a first profile and at least one second interlocking edge having a second profile, wherein the first profile and the second profile are complementary to each other and are located on opposing sides from one another. The edges are formed such that two articles may be joined together along the complementary profiles as shown in FIGS. 1A–1C, by approaching the first edge profile of a first article with the second edge profile of a second article from an angle, α, as shown in FIG. 1B. The first profile is incorporated into article 10, and has first male member 11, upper first female member 12, and lower first female member 13. The second profile is incorporated into article 20, and has second female member 21, upper second male member 22, and lower second male member 23. First male member 11 is slightly tapered toward its distal end to provide for unrestricted insertion into female member 21, as shown in FIG. 1B. Once member 11 is positioned within member 21, article 20 is lowered such that the surfaces of the two articles 10 and 20 become substantially coplanar. The edge profile of each article is formed in a pattern such that upon engagement, as shown in FIG. 1C, the seam between the two articles is substantially gapless. The interlocking is sufficient to prevent separation of the two adjoining articles upon application of a tensile force on the articles along a vector parallel to the surfaces and perpendicular to the longitudinal direction of the seam, without breaking one or both of the edge profiles. The edge profiles are also formed to provide an approach angle α, as shown in FIG. 1B, of from 10 to 45 degrees, preferably from 10 to 20 degrees, most preferably 15–18 degrees. Although articles 10 and 20 may not be pulled apart as described above, it is preferable that the complementary profiles be configured so that an engaged seam allows the adjoined articles 10 and 20 to slide relative to one another in a direction parallel to the longitudinal axis of the seam, for reasons that will be described below.

Figure 2A:
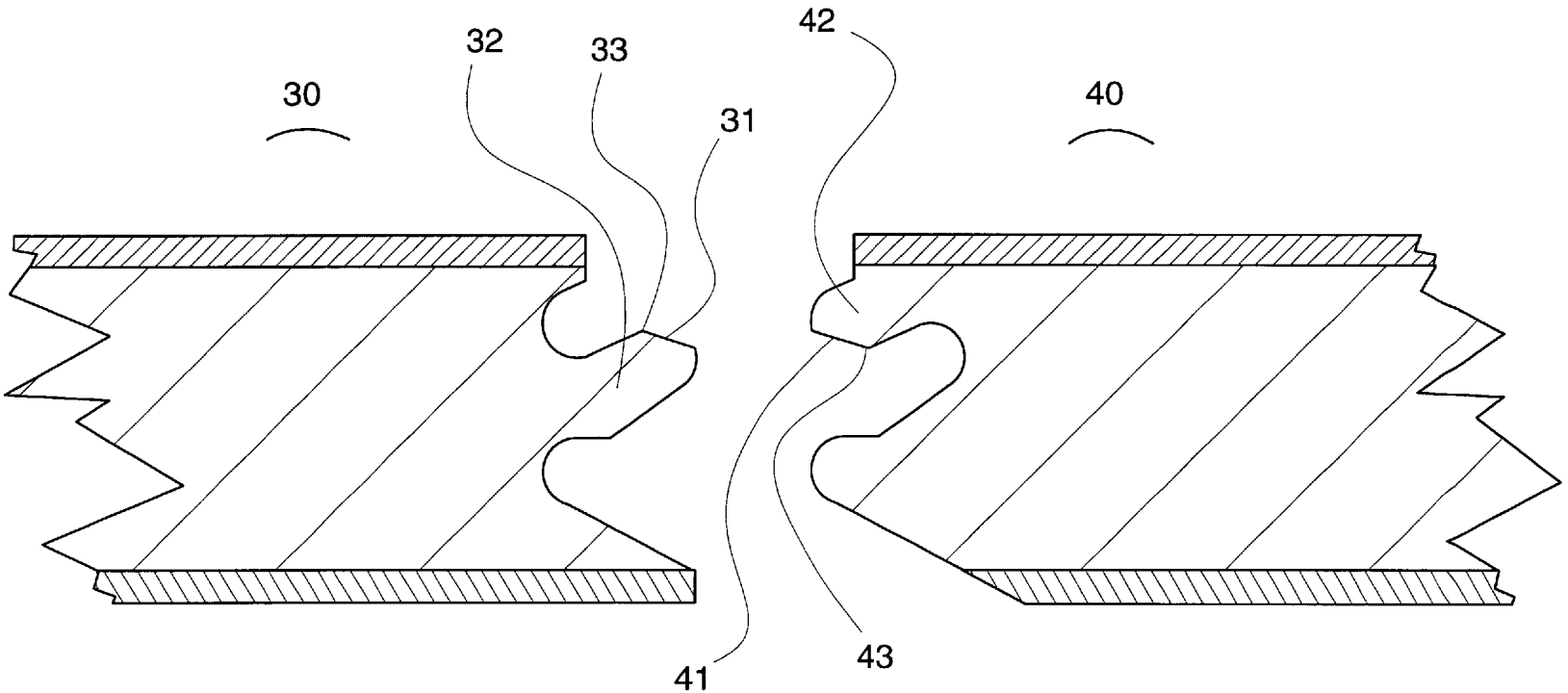
FIG. 2A shows an embodiment of the interlocking profiles of the end edges of the present invention.
Figure 2B:
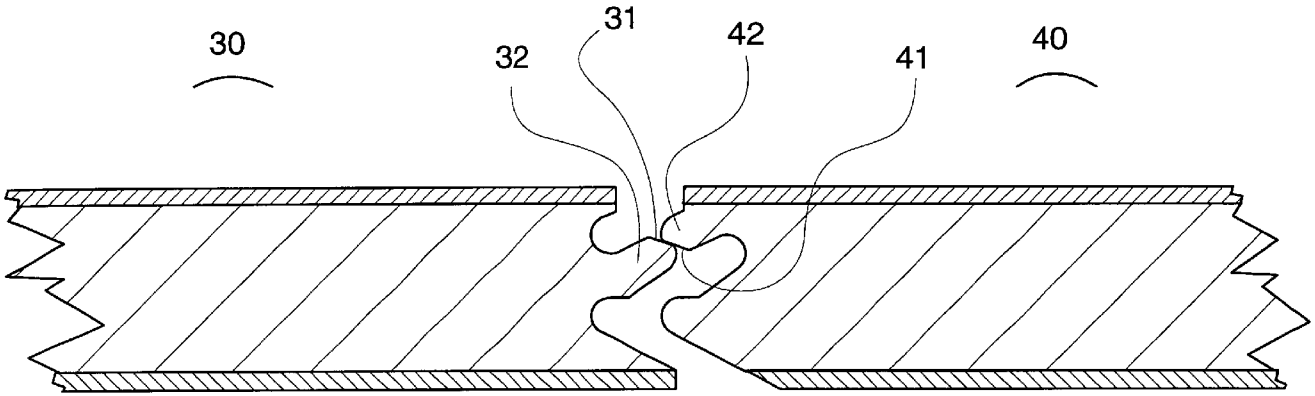
FIG. 2B shows preliminary engagement of the interlocking profiles of FIG. 2A.
Figure 2C:
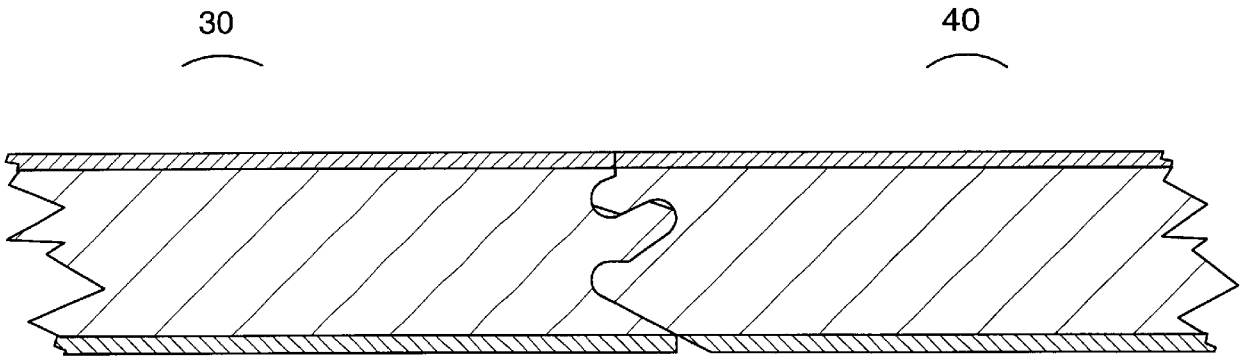
FIG. 2C shows final engagement of the interlocking profiles of FIG. 2A.

A preferred embodiment would also include first and second end profiles, as shown on articles 30 and 40 in FIGS. 2A–2C. The end profiles are configured substantially the same as the edge profiles shown in FIGS. 1A–1C, with the exception that the first profile has upward and outward facing surface 31 notched into first male member 32 and the second profile has downward and outward facing surface 41 notched into upper second male member 42. This configuration allows these ends to be joined together by sliding article 30, which has previously been engaged with adjacent articles along its edge, forward and pushing its end profile into the end profile of article 40 so as to snap the first and second end profiles together into place.

As surfaces 31 and 41 come toward each other and begin to engage, surface 41 ramps up onto surface 31. As surface 41 ramps further and further up onto surface 31, a point is reached where first point 33 and second point 43 ride up onto and over each other. This action requires a given amount of compressive force, both in the horizontal and vertical directions. Members 32 and 42 must flex to some degree to allow points 33 and 43 to ride over each other, but once this takes place, members 32 and 42 snap back into their original positions and articles 30 and 40 are pulled toward each other. This is due to the fact that point 33 is higher than point 43, which causes member 32 to ride up into the cavity under member 42.

Substantially all of the materials used to make the articles of the present invention have enough flexibility to provide for this snap engagement of the end profiles described above. These end profiles also cannot be pulled apart by pulling the pieces in opposite directions without breakage of the profiles due to the interlocking configuration of the profiles.

Figure 3A:
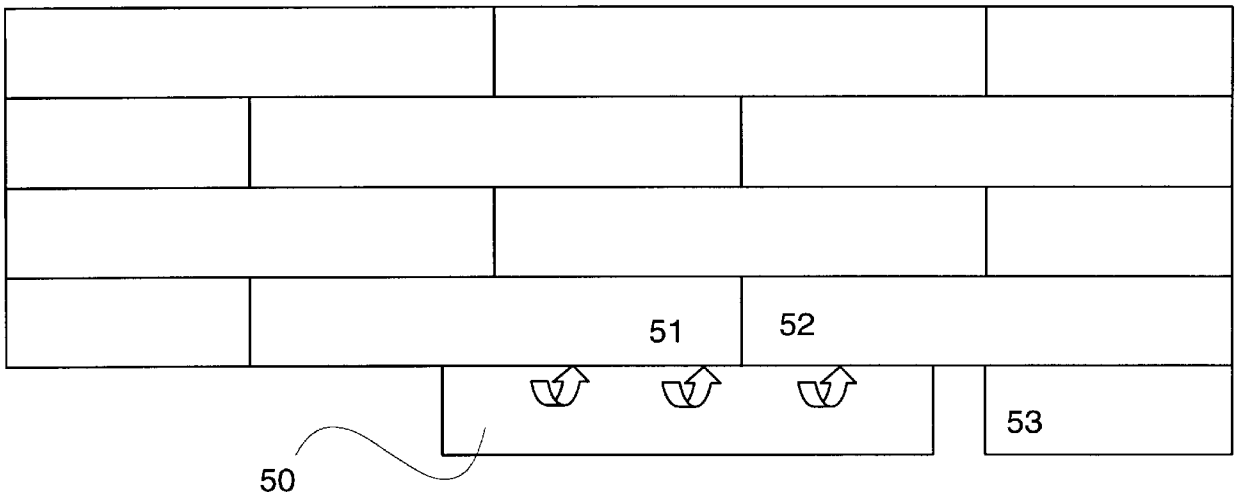
FIG. 3A shows engagement of the side edges of adjacent floor panels embodying the present invention.
Figure 3B:
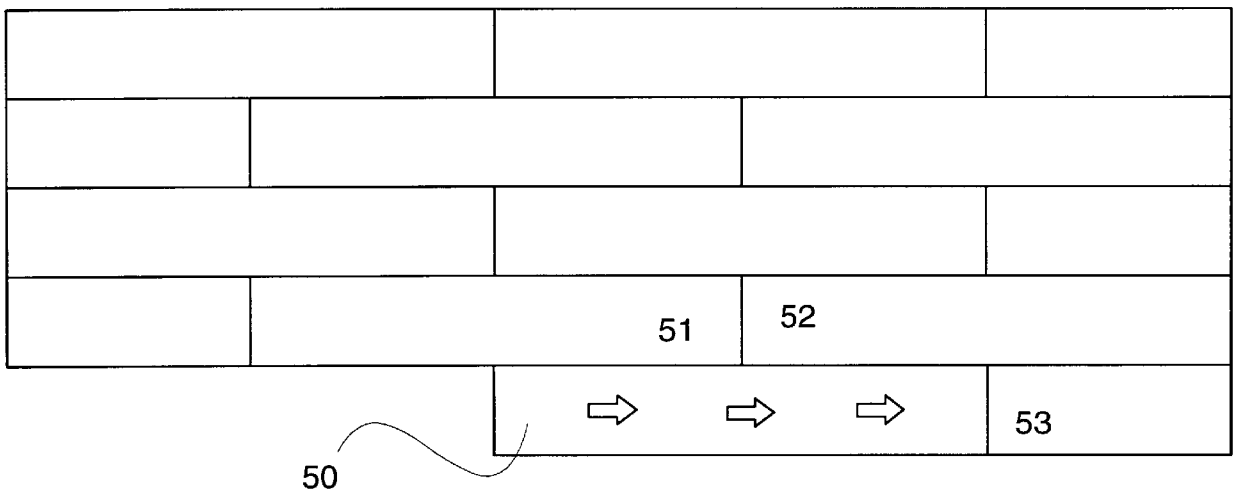
FIG. 3B shows engagement of the end edges of adjacent floor panels embodying the present invention.

FIGS. 3A and 3B show how a plurality of articles embodying the present invention would be put together to form, for example, a floor. FIG. 3A shows how an edge of an article 50 would be rotatably engaged to adjacent articles 51 and 52, as described above with respect to FIGS. 1A–1C. FIG. 3B shows how an end of an article 50 would be slidably engaged to an end of an adjacent article 53, as described above with respect to FIGS. 2A–2C.

The profiles shown in FIG. 1A each have a planar index surface 14 and 24 respectively. The two planar index surfaces 14 and 24 are each substantially the same distance from the planar decorative surfaces 15 and 25. This provides for substantially coplanar registration of surfaces 15 and 25 with respect to each other.

The remaining description of the edge profile will center on the male edge of the preferred embodiment, with the understanding that the female edge is designed to provide the ease of construction qualities of the present invention and to be at least nearly completely exactly complementary to the male edge profile. Within the context of the present invention, the term "nearly completely" indicates that the lower surfaces of the male and female edges may not form a completely gapless seam, as shown in the gap 60 of FIG. 1C. This gap does not have to be present but is preferred in order to allow for wear in the cutting tools used to form the edge profile, which would otherwise cause a perfectly fitting seam to gradually force the lower planar surfaces away from coplanar. With the small gap 60 in the bottom of the edge, the production tooling can last longer between changes without detrimentally affecting the fit of the seam.

In the most preferred embodiment of FIGS. 1A–1C, the first profile has member 11 above the planar index surface 14. Between member 11 and planar decorative surface 15 is first upper female member 12. Member 11 is angled outwardly and upwardly from planar index surface 14 towards the plane formed by planar decorative surface 15 such that a first lower surface 16 of member 11 forms an angle θ with the planar index surface 14. Angle θ may be from 20 to 50 degrees, preferably from 25 to 45 degrees, most preferably from 30 to 40 degrees. Member 11 has a rounded distal end 17 and a first upper surface 18 that is nonparallel with first lower surface 16, such that surfaces 16 & 18 result in a slight taper of member 11 toward distal end 17. First upper surface 18 of member 11 also forms a lower surface of first upper female member 12. Below the planar index surface 14 is first lower female member 13 which has an upper surface that corresponds to planar index surface 14. The first and second profiles are complementary to the extent that upon engagement of complementary edge and/or end profiles of adjacent articles, a seam is formed that is substantially without gaps.

Figure 4A:
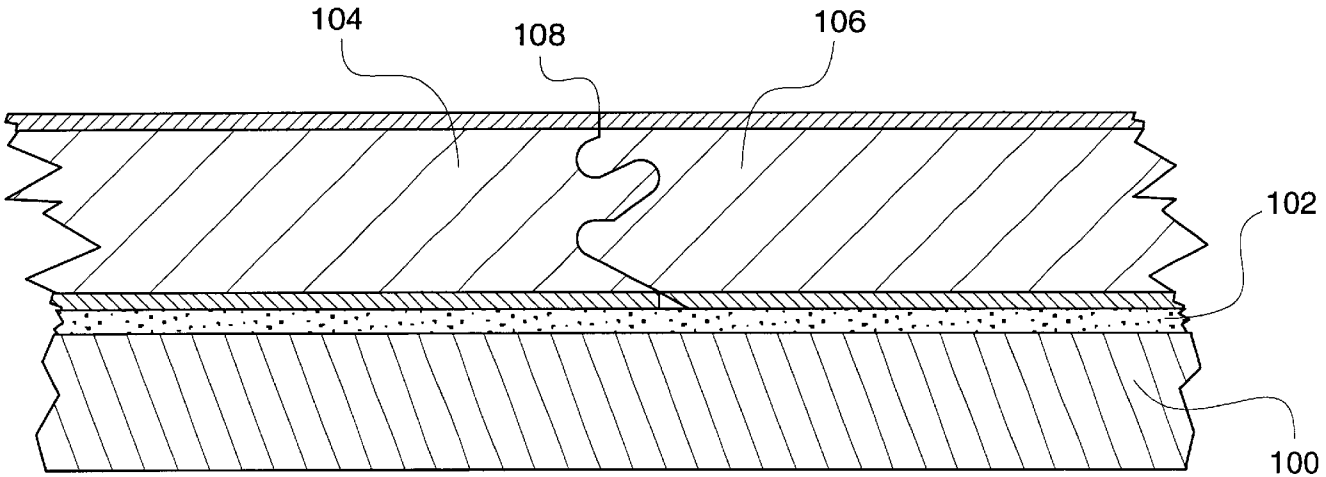
FIG. 4A shows the side edg e interlocking profiles of FIG. 1C as installed over a flexible pad.
Figure 4B:
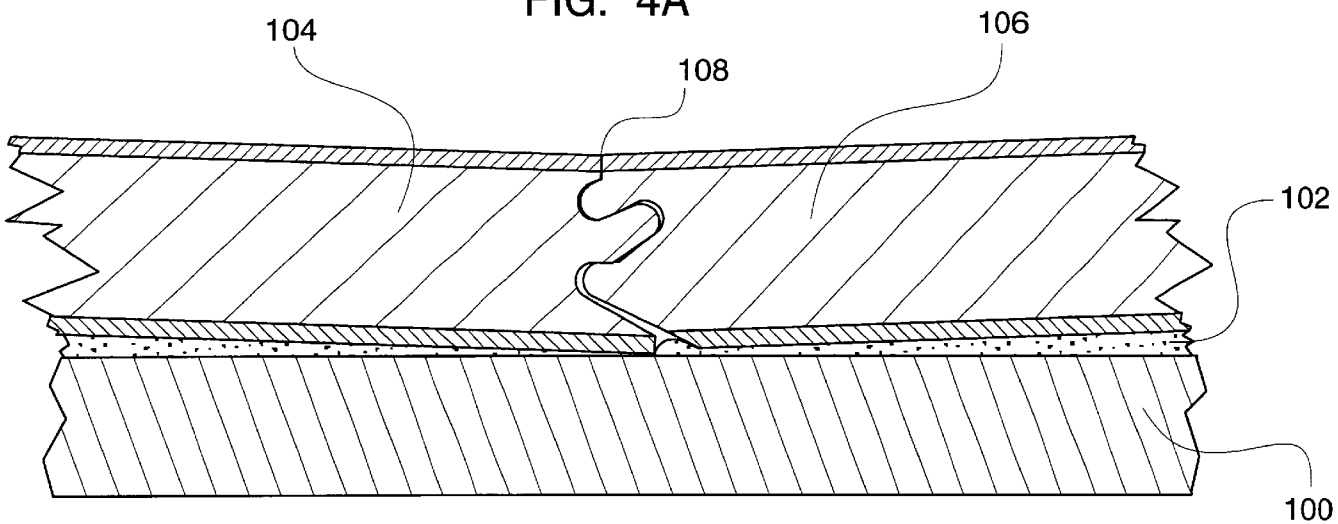
FIG. 4B shows how the embodiment of FIG. 3A reacts when subjected to pressure from above.

Referring now to FIGS. 4A and 4B, a typical "floating floor" system is shown. In a floating floor system, flooring panels are glued together along their edges. The panels are not attached in any way to the subfloor. The present invention eliminates the need for gluing individual panels together. Subfloor 100 is covered with flexible pad 102. First panel 104 and second panel 106 are attached as described above, and are placed directly onto flexible pad 102. As shown in FIG. 4B, when pressure is exerted onto seam area 108 the joint configuration of the present invention acts like a ball and socket joint thus allowing flexure in a way that will not result in wear and breakage associated with the seam joints of the prior art. Because the structural integrity of the resulting floor is heavily reliant on seam integrity, the present invention results is a floor that is much less likely to fail due to seam failures. Also, the present invention allows such a floor to be taken apart and put back together many, many times without wear or breakage of the seam components.

Obviously, additional modifications and variations of the present invention are possible in light of the above teachings. It is therefore to be understood that within the scope of the appended claims, the invention may be practiced otherwise than as specifically described herein.

I claim:

1. A rectilinear surfacing article comprising:

a substantially planar upper surface, at least one first interlocking edge having a first profile and at least one second interlocking edge having a second profile, the second profile being complementary to the first profile, the first profile comprising a male member located between two female members wherein the male member extends upwardly and outwardly toward a plane formed by the upper surface, and the second profile comprising a female member located between a first male member and a second male member wherein the first male member extends outwardly and downwardly from a plane formed by the upper surface;

the first profile further comprising a concavity on the first interlocking edge located between the upper surface and a proximal end of the male member of the first profile, and the second profile further comprising an upper male member on the second interlocking edge located between the upper surface and the female member of the second profile, the upper male member of the second interlocking edge having a convex distal end;

wherein the at least one first interlocking edge and the at least one second interlocking edge can be joined to a second adjacent article of like construction by a process comprising:

causing a first interlocking edge and a second interlocking edge of two adjacent articles to approach one another at an angle $\alpha$, wherein $\alpha$ represents an angle formed by the planar surfaces of the two articles;

engaging the complementary profiles of the articles; and causing the planar surfaces of the two articles to become coplanar;

to form a substantially gapless seam having a longitudinal direction, wherein the articles cannot be separated by a tensile force applied in the plane of the articles and substantially perpendicular to the longitudinal direction of the seam without breaking at least one of the interlocking edges, wherein engagement of the complementary profiles further forms a rotatable joint comprising the convex distal end of the upper male member of the second interlocking edge being seated into the concavity of the first interlocking edge, the rotatable joint being amenable to rotation about the seam when under pressure from above; and wherein the male member of the first profile includes an upwardly and outwardly facing surface having a notched surface at a distal end thereof and the first male member of the second profile includes a downwardly and outwardly facing surface having a notched surface at a distal end thereof, the notched surface of the first profile and the notched surface of the second profile being oriented for engagement as first and second profiles of two adjacent articles approach each such that the notched surface of the second profile ramps up onto the notched surface of the first profile until such a time that the notched surface of the second profile rides over the notched surface of the first profile and the male member of the first profile enters the female member of the second profile.

2. A rectilinear surfacing article comprising:

substantially planar surfaces including an upper planar surface and a lower planar surface, the upper planar surface and the lower planar surface being formed by laminating a surfacing material onto a central core, at least one first interlocking edge having a first profile and at least one second interlocking edge having a second profile, the second profile being complementary to the first profile, the first profile comprising a male member located between two female members wherein the male member extends outwardly and upwardly toward a plane formed by the upper planar surface, and the second profile comprising a female member located between a first male member and a second male member wherein the first male member extends outwardly and downwardly from a plane formed by the upper planar surface;

wherein the at least one first interlocking edge and the at least one second interlocking edge can be joined to a second adjacent article of like construction by a process comprising:

causing a first interlocking edge and a second interlocking edge of two adjacent articles to approach one another at an angle $\alpha$, wherein $\alpha$ represents an angle formed by the planar surfaces of the two articles;

engaging the complementary profiles of the articles; and causing the planar surfaces of the two articles to become coplanar;

to form a substantially gapless seam having a longitudinal direction, wherein the articles cannot be separated by a tensile force applied in the plane of the articles and substantially perpendicular to the longitudinal direction of the seam without breaking at least one of the interlocking edges.

3. The article of claim 2, wherein the central core is made of a material selected from the group consisting of fiberboard, solid polymeric materials, and foamed polymeric materials.

4. The article of claim 2, wherein the central core is made of a material selected from the group consisting of hydrophobic polymers.

5. The article of claim 2, wherein the upper planar surface and the lower planar surface are each, independently, selected from the group consisting of high pressure decorative laminates and polymeric surfacing materials.

6. The article of claim 2, wherein each of the upper planar surface and the lower planar surface are a high pressure decorative laminate and the central core is a foamed polymeric material.

7. The article of claim 6, wherein the foamed polymeric material is a foamed polyvinyl chloride, polyacrylonitrile-co-butadiene-co-styrene (ABS), polyamide, or high impact polystyrene (HIPS).

8. A rectilinear surfacing article comprising:

substantially planar surfaces including an upper planar surface, at least one first interlocking edge having a first profile and at least one second interlocking edge having a second profile, the second profile being complementary to the first profile, the first profile comprising a male member located between two female members wherein the male member extends outwardly and upwardly toward a plane formed by the upper planar surface, and the second profile comprising a female member located between a first male member and a second male member wherein the first male member extends outwardly and downwardly from a plane formed by the upper planar surface;

wherein the at least one first interlocking edge and the at least one second interlocking edge can be joined to a second adjacent article of like construction by a process comprising:

causing a first interlocking edge and a second interlocking edge of two adjacent articles to approach one another at an angle α, wherein α represents an angle formed by the planar surfaces of the two articles;

engaging the complementary profiles of the articles; and causing the planar surfaces of the two articles to become coplanar;

to form a substantially gapless seam having a longitudinal direction, wherein the articles cannot be separated by a tensile force applied in the plane of the articles and substantially perpendicular to the longitudinal direction of the seam without breaking at least one of the interlocking edges; and wherein the male member of the first profile includes an upwardly and outwardly facing surface having a notched surface at a distal end thereof and the first male member of the second profile includes a downwardly and outwardly facing surface having a notched surface at a distal end thereof, the notched surface of the first profile and the notched surface of the second profile being oriented for engagement as first and second profiles of two adjacent articles approach each such that the notched surface of the second profile ramps up onto the notched surface of the first profile until such a time that the notched surface of the second profile rides over the notched surface of the first profile and the male member of the first profile enters the female member of the second profile.

9. A rectilinear floor surfacing article installed over a flexible pad, the article comprising:

substantially planar surfaces including an upper planar surface, the article further including at least one first interlocking edge having a first profile and at least one second interlocking edge having a second profile, the second profile being complementary to the first profile, the first profile comprising a male member located between two female members wherein the male member extends outwardly and upwardly toward a plane formed by the upper planar surface, and the second profile comprising a female member located between a first male member and a second male member wherein the first male member extends outwardly and downwardly from a plane formed by the upper planar surface;

wherein the at least one first interlocking edge and the at least one second interlocking edge can be joined to a second adjacent article of like construction by a process comprising:

causing a first interlocking edge and a second interlocking edge of two adjacent articles to approach one another at an angle α, wherein α represents an angle formed by the planar surfaces of the two articles;

engaging the complementary profiles of the articles; and causing the planar surfaces of the two articles to become coplanar;

to form a substantially gapless seam having a longitudinal direction, wherein the articles cannot be separated by a tensile force applied in the plane of the articles and substantially perpendicular to the longitudinal direction of the seam without breaking at least one of the interlocking edges, the seam forming a flexible joint such that when weight is applied to the seam the articles rotate slightly about the joint as the seam is slightly depressed into the flexible pad, the flexible joint being constructed so as to prevent any damage from occurring to the first and second interlocking edges as a result of the rotation of the articles.

10. The article of claim 9, further comprising a lower planar surface, the upper planar surface and the lower planar surface being formed by laminating a surfacing material onto a central core.

11. The article of claim 10, wherein the central core is made of a material selected from the group consisting of fiberboard, solid polymeric materials, and foamed polymeric materials.

12. The article of claim 10, wherein the central core is made of a material selected from the group consisting of hydrophobic polymers.

13. The article of claim 10, wherein the upper planar surface and the lower planar surface are each, independently, selected from the group consisting of high pressure decorative laminates and polymeric surfacing materials.

14. The article of claim 10, wherein each of the upper planar surface and the lower planar surface are a high pressure decorative laminate and the central core is a foamed polymeric material.

15. The article of claim 14, wherein the foamed polymeric material is a foamed polyvinyl chloride, polyacrylonitrile-co-butadiene-co-styrene (ABS), polyamide, or high impact polystyrene (HIPS).

16. The article of claim 9, wherein the male member of the first profile includes an upwardly and outwardlv facing surface having a notched surface at a distal end thereof and the first male member of the second profile includes a downwardly and outwardly facing surface having a notched surface at a distal end thereof, the notched surface of the first profile and the notched surface of the second profile being oriented for engagement as first and second profiles of two adjacent articles approach each such that the notched surface of the second profile ramps up onto the notched surface of the first profile until such a time that the notched surface of the second profile rides over the notched surface of the first profile and the male member of the first profile enters the female member of the second profile.

17. A rectilinear surfacing article comprising:

substantially planar surfaces including an upper planar surface, at least one first interlocking edge having a first profile and at least one second interlocking edge having a second profile, the second profile being complementary to the first profile, the first profile comprising a male member located between two female members wherein the male member extends outwardly and upwardly toward a plane formed by the upper planar surface, and the second profile comprising a female member located between a first male member and a second male member wherein the first male member extends outwardly and downwardly from a plane formed by the upper planar surface;

wherein the at least one first interlocking edge and the at least one second interlocking edge can be joined to a second adjacent article of like construction by a process comprising:

causing a first interlocking edge and a second interlocking edge of two adjacent articles to approach one another at an angle α, wherein α represents an angle formed by the planar surfaces of the two articles;

engaging the complementary profiles of the articles; and causing the planar surfaces of the two articles to become coplanar;

to form a substantially gapless seam having a longitudinal direction, wherein the articles cannot be separated by a tensile force applied in the plane of the articles and substantially perpendicular to the longitudinal direction of the sewn without breaking at least one of the interlocking edges, wherein the articles may be joined and unjoined a plurality of times without functional deterioration of the first and second interlocking edges; and wherein the male member of the first profile includes an upwardly and outwardly facing surface having a notched surface at a distal end thereof and the first male member of the second profile includes a downwardly and outwardly facing surface having a notched surface at a distal end thereof, the notched surface of the first profile and the notched surface of the second profile being oriented for engagement as first and second profiles of two adjacent articles approach each such that the notched surface of the second profile ramps up onto the notched surface of the first profile until such a time that the notched surface of the second profile rides over the notched surface of the first profile and the male member of the first profile enters the female member of the second profile.

18. A rectilinear surfacing article comprising:

substantially planar surfaces including an upper planar surface and a lower planar surface, the upper planar surface and the lower planar surface being formed by laminating a surfacing material onto a central core, at least one first interlocking edge having a first profile and at least one second interlocking edge having a second profile, the second profile being complementary to the first profile, the first profile comprising a male member located between two female members wherein the male member extends outwardly and upwardly toward a plane formed by the upper planar surface, and the second profile comprising a female member located between a first male member and a second male member wherein the first male member extends outwardly and downwardly from a plane formed by the upper planar surface;

wherein the at least one first interlocking edge and the at least one second interlocking edge can be joined to a second adjacent article of like construction by a process comprising:

causing a first interlocking edge and a second interlocking edge of two adjacent articles to approach one another at an angle $\alpha$, wherein $\alpha$ represents an angle formed by the planar surfaces of the two articles;

engaging the complementary profiles of the articles; and causing the planar surfaces of the two articles to become coplanar;

to form a substantially gapless seam having a longitudinal direction, wherein the articles cannot be separated by a tensile force applied in the plane of the articles and substantially perpendicular to the longitudinal direction of the sewn without breaking at least one of the interlocking edges, wherein the articles may be joined and unjoined a plurality of times without functional deterioration of the first and second interlocking edges.

19. The article of claim 18, wherein the central core is made of a material selected from the group consisting of fiberboard, solid polymeric materials, and foamed polymeric materials.

20. The article of claim 18, wherein the central core is made of a material selected from the group consisting of hydrophobic polymers.

21. The article of claim 18, wherein the upper planar surface and the lower planar surface are each, independently, selected from the group consisting of high pressure decorative laminates and polymeric surfacing materials.

22. The article of claim 18, wherein each of the upper planar surface and the lower planar surface are a high pressure decorative laminate and the central core is a foamed polymeric material.

23. The article of claim 22, wherein the foamed polymeric material is a foamed polyvinyl chloride, polyacrylonitrile-co-butadiene-co-styrene (ABS), polyamide, or high impact polystyrene (HIPS).

24. A rectilinear surfacing article comprising:

a substantially planar upper surface and a lower planar surface, the upper surface and the lower planar surface being formed by laminating a surfacing material onto a central core, at least one first interlocking edge having a first profile and at least one second interlocking edge having a second profile, the second profile being complementary to the first profile, the first profile comprising a male member located between two female members wherein the male member extends upwardly and outwardly toward a plane formed by the upper surface, and the second profile comprising a female member located between a first male member and a second male member wherein the first male member extends outwardly and downwardly from a plane formed by the upper surface;

the first profile further comprising a concavity on the first interlocking edge located between the upper surface and a proximal end of the male member of the first profile, and the second profile further comprising an upper male member on the second interlocking edge located between the upper surface and the female member of the second profile, the upper male member of the second interlocking edge having a convex distal end;

wherein the at least one first interlocking edge and the at least one second interlocking edge can be joined to a second adjacent article of like construction by a process comprising:

causing a first interlocking edge and a second interlocking edge of two adjacent articles to approach one another at an angle $\alpha$, wherein $\alpha$ represents an angle formed by the planar surfaces of the two articles;

engaging the complementary profiles of the articles; and causing the planar surfaces of the two articles to become coplanar;

to form a substantially gapless seam having a longitudinal direction, wherein the articles cannot be separated by a tensile force applied in the plane of the articles and substantially perpendicular to the longitudinal direction of the seam without breaking at least one of the interlocking edges, wherein engagement of the complementary profiles further forms a rotatable joint comprising the convex distal end of the upper male member of the second interlocking edge being seated into the concavity of the first interlocking edge, the rotatable joint being amenable to rotation about the seam when under pressure from above.

25. The article of claim 24, wherein the central core is made of a material selected from the group consisting of fiberboard, solid polymeric materials, and foamed polymeric materials.

26. The article of claim 24, wherein the central core is made of a material selected from the group consisting of hydrophobic polymers.

27. The article of claim 24, wherein the upper planar surface and the lower planar surface are each, independently, selected from the group consisting of high pressure decorative laminates and polymeric surfacing materials.

28. The article of claim 24, wherein each of the upper planar surface and the lower planar surface are a high pressure decorative laminate and the central core is a foamed polymeric material.

29. The article of claim 28, wherein the foamed polymeric material is a foamed polyvinyl chloride, polyacrylonitrile-co-butadiene-co-styrene (ABS), polyamide, or high impact polystyrene (HIPS).

30. A rectilinear surfacing article comprising:

substantially planar surfaces including an upper planar surface, one first interlocking edge having a first edge profile, one second interlocking edge having a second edge profile, the second edge profile being complementary to the first edge profile, the first edge profile comprising a male member located between two female members wherein the male member extends outwardly and upwardly toward a plane formed by the upper planar surface, and the second edge profile comprising a female member located between a first male member and a second male member wherein the first male member extends outwardly and downwardly from a plane formed by the upper planar surface;

wherein the first interlocking edge of a first article may be engaged with the second interlocking edge of a second article of like construction by a process comprising:

causing a first interlocking edge of a first article and a second interlocking edge of a second article to approach one another at an angle $\alpha$, wherein $\alpha$ represents an angle formed by the planar surfaces of the two articles;

engaging the complementary edge profiles of the articles; and causing the planar surfaces of the two articles to become coplanar;

to form a substantially gapless seam having a longitudinal axis;

the rectilinear surfacing article further comprising one first interlocking end having a first end profile, one second interlocking end having a second end profile, the second end profile being substantially complementary to the first end profile, the first end profile comprising a male member located between two female members, and the second end profile comprising a female member located between two male members;

wherein the first interlocking end of a first article may be engaged with the second interlocking end of a third article of like construction by a process comprising:

sliding a first article along the longitudinal axis of a previously engaged interlocked edge;

engaging the complementary end profiles of the articles; and snapping the complementary end profiles together to form a substantially gapless end seam.

31. The article of claim 30, further comprising a lower planar surface, the upper planar surface and the lower planar surface being formed by laminating a surfacing material onto a central core.

32. The article of claim 31, wherein the central core is made of a material selected from the group consisting of fiberboard, solid polymeric materials, and foamed polymeric materials.

33. The article of claim 31, wherein the central core is made of a material selected from the group consisting of hydrophobic polymers.

34. The article of claim 31, wherein the upper planar surface and the lower planar surface are each, independently, selected from the group consisting of high pressure decorative laminates and polymeric surfacing materials.

35. The article of claim 31, wherein each of the upper planar surface and the lower planar surface are a high pressure decorative laminate and the central core is a foamed polymeric material.

36. The article of claim 35, wherein the foamed polymeric material is a foamed polyvinyl chloride, polyacrylonitrile-co-butadiene-co-styrene (ABS), polyamide, or high impact polystyrene (HIPS).

37. The article of claim 33, wherein the male member of the first profile includes an upwardly and outwardly facing surface having a notched surface at a distal end thereof and the first male member of the second profile includes a downwardly and outwardly facing surface having a notched surface at a distal end thereof, the notched surface of the first profile and the notched surface of the second profile being oriented for engagement as first and second profiles of two adjacent articles approach each such that the notched surface of the second profile ramps up onto the notched surface of the first profile until such a time that the notched surface of the second profile rides over the notched surface of the first profile and the male member of the first profile enters the female member of the second profile.

* * * * *